US006915532B1

(12) United States Patent
Mohammed

(10) Patent No.: US 6,915,532 B1
(45) Date of Patent: Jul. 12, 2005

(54) POWERED TOILET SEAT POSITIONER

(76) Inventor: Gaffar Mohammed, 3080 Peace Court, Windsor, Ontario (CA) N8T 2J4

( * ) Notice: Subject to any disclaimer, the term of this patent is extended or adjusted under 35 U.S.C. 154(b) by 946 days.

(21) Appl. No.: 09/710,814

(22) Filed: Nov. 7, 2000

(51) Int. Cl.[7] ..... A47K 13/10
(52) U.S. Cl. ..... 4/246.1
(58) Field of Search ..... 4/246.1, 246.2, 4/246.3, 246.4, 246.5

(56) References Cited

U.S. PATENT DOCUMENTS 4,055,864 A * 11/1977 Liu et al. ..... 4/246.1 X
5,603,127 A * 2/1997 Veal ..... 4/246.1
6,226,804 B1 * 5/2001 Ballard ..... 4/246.1

* cited by examiner

*Primary Examiner*—Robert M. Fetsuga
(74) *Attorney, Agent, or Firm*—John R Benefiel

(57) ABSTRACT

A powered toilet seat positioner in which a reversible electric motor drives a lift member pivoted to the toilet seat. In one embodiment, a double shafted electric motor drives a pair of curved lift arms each connected at on outer end to one side of the toilet seat. In another embodiment, a nut is connected to a lift rod, the nut driven up or down on a threaded shaft driven by the motor to raise and lower the toilet seat. In a third embodiment, an inner sleeve telescoped into an outer sleeve is driven up and down by the electric motor, the two sleeves pivotally supported on an upright stanchion resting alongside the toilet. The inner sleeve is pivotally connected at its top to the toilet seat to raise or lower the same.

3 Claims, 2 Drawing Sheets

POWERED TOILET SEAT POSITIONER

BACKGROUND OF THE INVENTION

This invention concerns toilet seats (including lids) which are hinged to able to be raised when the toilet is being used by a male.

The proper positioning of a toilet seat has long been a troublesome necessity.

The need to move the seat by hand makes many users reluctant to raise the seat in public restrooms. Improper seat use is a public health issue due to the possible spread of disease as a result.

Even within a private household proper seat positioning may be a problem as well as to an inconvenience and a source of discord especially between male and female householders.

It has long been recognized that powering toilet seat movement would alleviate this situation since it would end the need to manually lift or lower the seat. Electric motor drive arrangements for raising and lowering toilet seats have thus heretofore been proposed, but these arrangements have been complex and necessitated major modifications to a conventional toilets, precluding retrofitting to existing toilet seats.

Accordingly, it is an object of the present invention to provide a simplified powered toilet seat positioner able to be installed in existing toilets.

SUMMARY OF THE INVENTION

This object and others which will become apparent upon a reading of the following specification and claims are accomplished by coupling an electric drive motor to a seat engagement arrangement which can directly raise a conventional toilet seat without modification.

The toilet seat engagement arrangement in a first embodiment comprises a pair of curved lift arms each extending along one side of the toilet seat, each arm driven by a reversible electric motor located behind the toilet having an output shaft axis parallel to the seat hinge axis. The electric motor when energized swings the arms up or down to raise or lower the toilet seat. The arms are comprised of two segments telescoped together to allow extension thereof as the toilet seat is swung up to accommodate the changing distance between the electric motor and the point of attachment of each arm to the toilet seat.

In another embodiment, a threaded shaft is driven by a small reversible electric motor to cause a threaded nut to be moved up or down the threaded shaft, both of these elements enclosed in a casing sleeve mounted upright on the floor along side the toilet bowl, stabilized at the top with a hooked bracing piece engaging the toilet bowl rim. An actuation rod is connected at one end to the nut by to a pivot connection extending through a lengthwise slot in the casing sleeve, and at the other end to one side of the toilet seat to drive the toilet seat up or down by the electric motor.

The actuation rod is guided at is upper and by passing through a slotted end in the bracing piece, which accommodates the changing angle of the rod as the toilet seat is driven up or down.

In still another embodiment, telescoped inner and outer sleeves are mounted alongside the toilet bowl on an upright floor stanchion braced at the top by being hooked over the toilet bowl. The outer sleeve is pivoted on one side to the stanchion. The inner sleeve has a pivotal connection to the toilet seat on one side of a protruding upper end. The inner sleeve is selectively driven in or out of the outer sleeve to raise or lower the toilet seat by a small reversible electric motor mounted on the outer sleeve driving a gear meshed with a gear rack extending along the inner sleeve through a slot in the outer sleeve.

The two sleeves can swing slightly about the pivot connection of the outer sleeve to the floor stanchions to accommodate the toilet seat motion.

DETAILED DESCRIPTION

Figure 2:
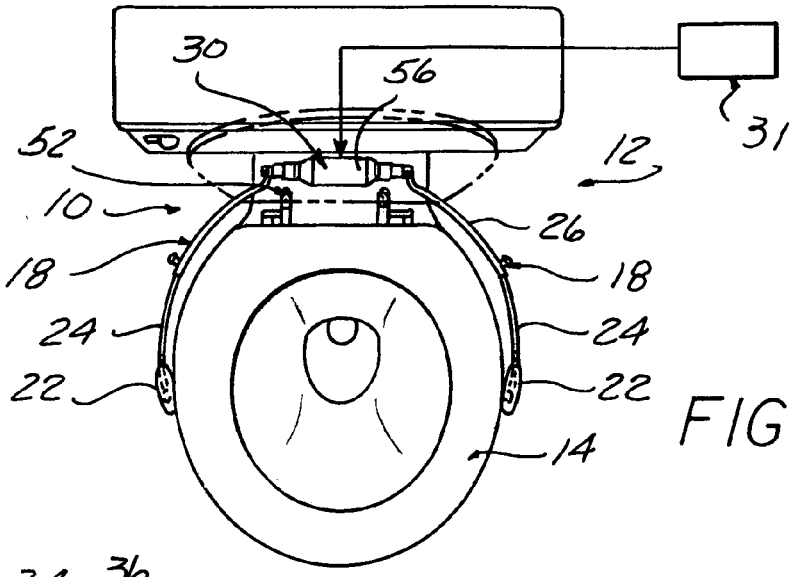
FIG. 2 is a plan view of the toilet equipped with the seat positioner according to the invention.
Figure 5:
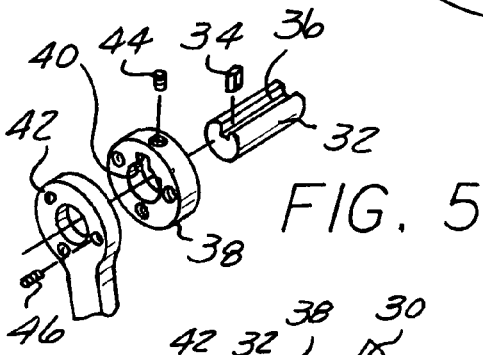
FIG. 5 is an enlarged perspective view of one lift arm connection to one end of the electric motor, shown in fragmentary form.
Figure 1:
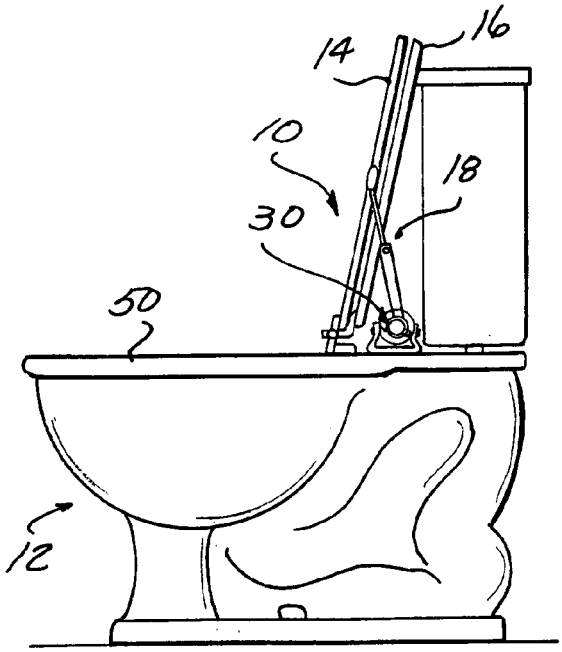
FIG. 1 is a side elevational view of a conventional toilet equipped with the powered seat raising and lowering positioner according to the invention.
Figure 4:
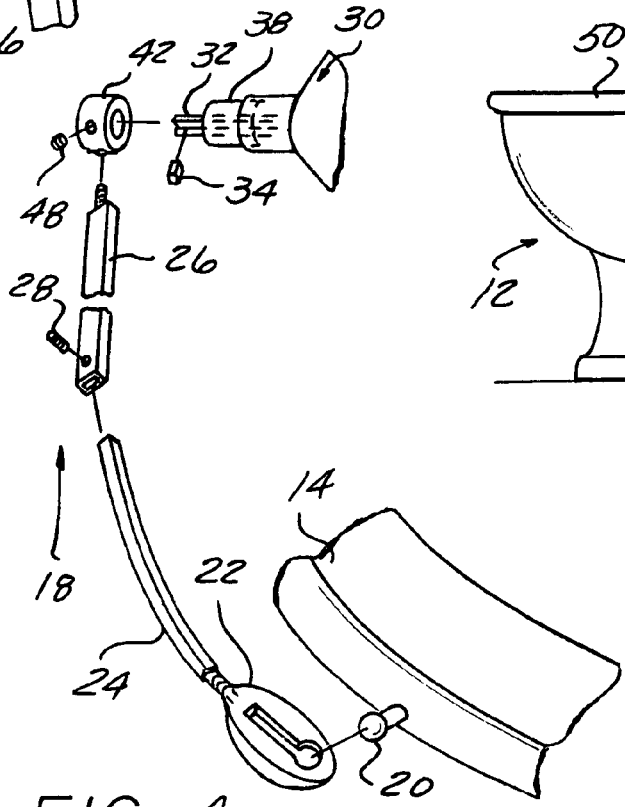
FIG. 4 is an exploded perspective enlarged view of one of the lift arm assemblies and connections to the electric motor and toilet seat, each shown in fragmentary form.
Figure 3:
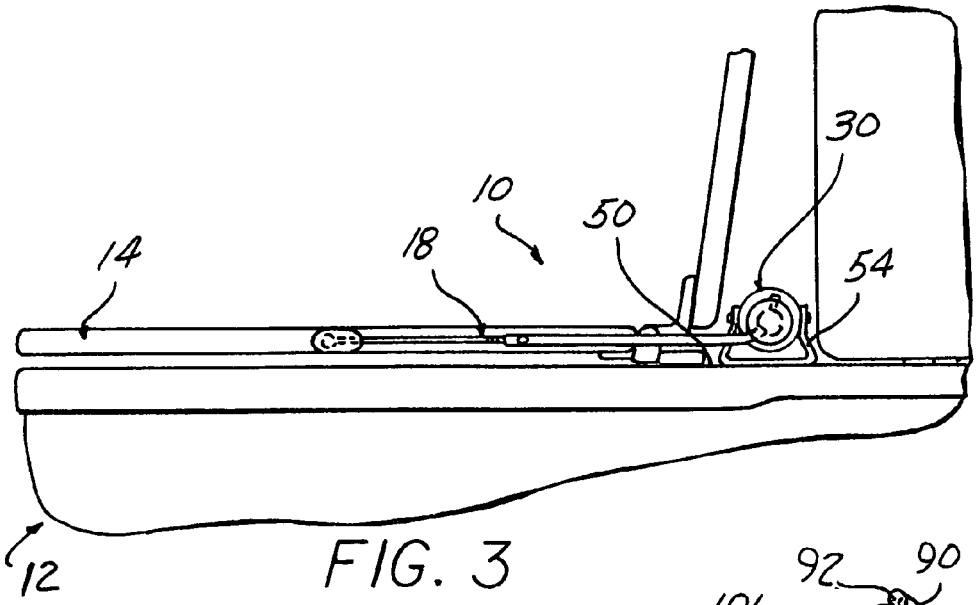
FIG. 3 is an enlarged fragmentary side elevational view of the toilet shown in FIG. 1 showing the toilet seat in the lowered position.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, and particularly FIGS. 1–5, a first embodiment of a powered toilet seat positioner 10 according to the invention is shown installed on a conventional toilet 12 to lift and lower the toilet seat 14 (and lid 16) without the need to make physical contact with the seat 14.

The positioner 10 includes a pair of two part lift arms 18, each curved in complementary fashion to a respective side of the toilet seat 14, with each arm installed extending along a respective side of the seat 14 as shown in FIG. 2.

An outboard end of each lift arm 18 is pivotally attached to one side of the toilet seat 14 by a ball anchor 20 fixed in the toilet seat projecting to one side, and captured in a key holed fitting 22 threaded to an outboard rod part 24 of the arm 18.

An inboard arm rectangular tube part 26 slidably receives the inner end of the part 24 to be telescoped thereinto. A set screw 28 on the part 26 frictionally engages the rod part 24.

The inner end of each inboard arm part 26 is rotationally fixed to a respective output shaft 32 of a double shafted reversible electric motor 30. The shaft 32 has a keyway 36 receiving a key 34. A coupling ring 38 is received over the motor shaft 32 and has a keyway 40 also mating with the key 34 held with a set screw 44. An eye 42 is threaded to the inside end of each inboard arm part 26 and is fixed to the collar 38 with screws 46. A set screw 48 prevents loosening of the threaded connection between each eye 42 and arm part 26.

The double shafted reversible electric motor 30 is selectively energized for rotation in either directionally by operation of a suitable switch 31 (FIG. 2), which could be wall or floor mounted, wired to the building power supply.

The motor 30 is mounted to the toilet bowl 50 just to the rear of the toilet seat hinges 52, as with a bracket 54 and bolts (not shown) or a bonded connection.

A slidable cover 56 may provide an improved appearance of the motor 30 and drive couplings to the lift arms 18.

Thus, when the motor 30 is energized, the arms 18 swing up or down to raise or lower the toilet seat 14, the telescoping arm parts 24, 26 accommodating the changing distance between the motor shafts 32 and the points of connection to the seat sides.

Figure 6:
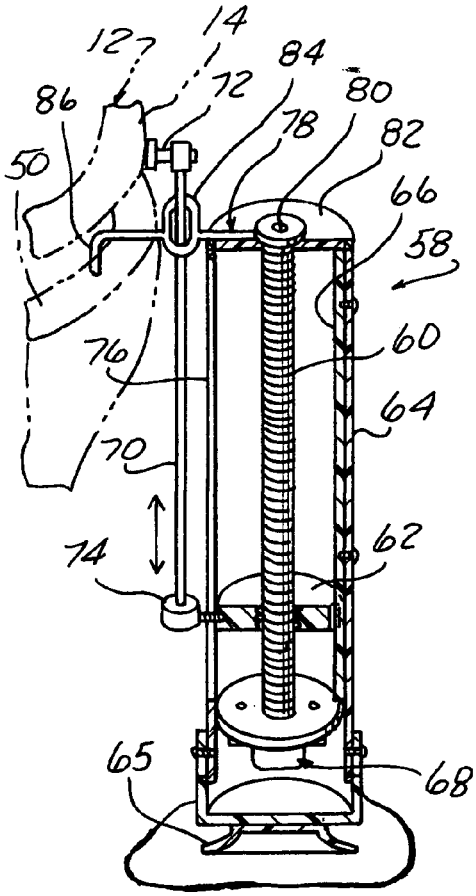
FIG. 6 is a perspective view of a second embodiment of a toilet seat position according to the invention, in partial section, with a fragmentary portion of an associated toilet bowl and seat shown in phantom lines.

FIG. 6 shows a second embodiment of a powered toilet seat position 58, comprising a threaded shaft 60 on which a nut 62 is received, guided within a casing sleeve 64. A key 66 engages a slot in the nut 62 to prevent rotation of the nut 62. Thus, when the shaft 60 is rotated by a reversible electric motor 68, the nut 62 is traversed up or down on the threaded shaft 60.

The casing 64 rests on the floor to one side of the toilet 12 with a suction cup 65 stabilizing its position.

A lifting rod 70 is connected at its upper end to one side of a toilet seat 14 with a pivot pin 72. The lower end of the rod 70 is carried on a pivots 74 mounted to the nut 62 and extending through a slot 76 extending along one side of the casing 64.

A stabilizer bracket 78 is fixed to a screw 80 used also to attach the upper end of the shaft 60 to the top 82 of casing 64. An elongated eye 84 is formed into the bracket 78 through which the lift rod 76 is extended. A hook end 86 of the stabilizer bracket 78 is hooked over the rim of the toilet bowl 50 to hold the casing 64 in position.

As the nut 62 is moved up or down to cause the lift rod 70 to raise or lower the seat 14, the slight swinging movement is accommodated by the eye 84 and pivoting of the connection 74, 72.

Figure 8:
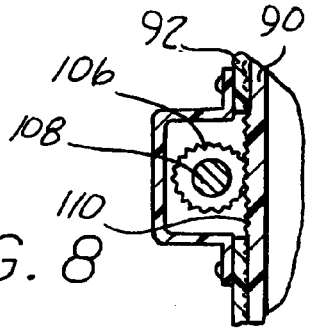
FIG. 8 is an enlarged sectional view of a drive pinion gear and engaged gear rack included in the third embodiment.
Figure 7:
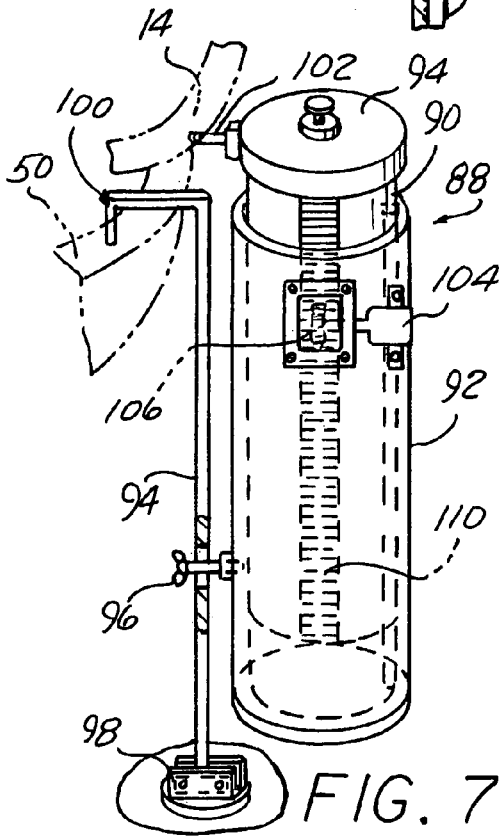
FIG. 7 is a perspective view of a third embodiment of a toilet seat position according to the invention, in partial section, with an associated toilet bowl and seat shown in phantom lines.

FIGS. 7 and 8 show a third embodiment of a toilet seat position 88, which includes an inner sleeve 90 comprising a toilet seat lift member and an outer sleeve 92 telescoped together, with the upper end 94 of the inner sleeve 90 protruding out of the open upper end of the outer sleeve 92.

The telescoped inner and outer sleeves 90, 92 are pivotally supported on a floor mounted stanchion 94 by means of a screw 96.

The stanchion has a base 98 resting on the floor adjacent one side of the toilet bowl 50.

The inner sleeve upper end 94 is pivotally attached to the adjacent side of the toilet seat 14 with a pivot pin 102.

The inner sleeve 90 is driven up and down to raise and lower the toilet seat 14 by a small reversible electric motor 104 mounted to the exterior of the outer sleeve 92. A pinion gear 106 is affixed to the motor output shaft 108 to be rotated therewith, gear 106 in engagement with a gear rack 110 to cause the inner sleeve 90 to be driven up and down.

The inner and outer sleeves 90, 92 pivot as the seat 14 is driven up or down to accommodate the changing position of the toilet seat 14.

Thus, a simple but effective powered toilet seat positioner has been described.

What is claimed is:

1. A powered toilet seat positioner in combination with a toilet for raising and lowering a hinged toilet seat of said toilet, comprising:

a reversible electric motor mounted behind a hinged side of said toilet seat and having an output shaft protruding from each end of said motor;

a pair of lift arms each attached at an outer end to one side of said toilet seat and having an inner end drivingly coupled to a respective protruding end of said output shaft of said electric motor;

said output shaft of said reversible electric motor drivingly connected to said lift member to cause movement thereof in raising and lowering directions by energization of said electric motor to rotate in either direction to in turn cause raising and lowering of said toilet seat; and a switch for selectively energizing said electric motor for rotation in either direction.

2. The combination according to claim 1 wherein each lift arm curves around a respective side of said toilet seat.

3. The combination according to claim 2 wherein each of said lift arms are of two part construction, said two parts telescoped together.

* * * * *